US010926541B2

(12) United States Patent
Williams et al.

(10) Patent No.: US 10,926,541 B2
(45) Date of Patent: Feb. 23, 2021

(54) PRINTING DEVICE

(71) Applicant: Hewlett-Packard Development Company, L.P., Spring, TX (US)

(72) Inventors: Kenneth R Williams, Vancouver, WA (US); Matt G Driggers, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/337,078

(22) PCT Filed: Oct. 17, 2016

(86) PCT No.: PCT/US2016/057321
§ 371 (c)(1),
(2) Date: Mar. 27, 2019

(87) PCT Pub. No.: WO2018/074990
PCT Pub. Date: Apr. 26, 2018

(65) Prior Publication Data
US 2020/0031128 A1 Jan. 30, 2020

(51) Int. Cl.

| | |
|---|---|
| ***B41J 2/165*** | (2006.01) |
| ***B41J 25/304*** | (2006.01) |
| ***B41J 29/02*** | (2006.01) |
| ***B41J 25/00*** | (2006.01) |

(52) U.S. Cl.
CPC ..... *B41J 2/16508* (2013.01); *B41J 2/16585* (2013.01); *B41J 25/001* (2013.01); *B41J 25/304* (2013.01); *B41J 2202/15* (2013.01)

(58) Field of Classification Search
CPC ..... B41J 2/16585
See application file for complete search history.

(56) References Cited

U.S. PATENT DOCUMENTS

| | | | | |
|---|---|---|---|---|
| 5,801,726 | A * | 9/1998 | Freudenberger | B41J 2/16547 347/32 |
| 7,988,255 | B2 | 8/2011 | Balcan et al. | |
| 8,246,145 | B2 | 8/2012 | Roth et al. | |
| 8,398,205 | B2 | 3/2013 | Roth et al. | |
| 8,430,585 | B2 | 4/2013 | Hendricks et al. | |
| 9,242,493 | B2 | 1/2016 | Campillo et al. | |
| 2004/0061735 | A1 | 4/2004 | Balcan et al. | |
| 2004/0095416 | A1* | 5/2004 | Chang | B41J 2/16547 347/29 |

(Continued)

FOREIGN PATENT DOCUMENTS

| | | |
|---|---|---|
| CN | 1721201 | 1/2006 |
| CN | 1853941 | 11/2006 |

(Continued)

*Primary Examiner* — Shelby L Fidler
(74) *Attorney, Agent, or Firm* — Dicke Billig & Czaja PLLC

(57) ABSTRACT

An example printing device include a frame, a printbar, a lift mechanism, and a lock. The lift mechanism is operably coupled to move the printbar from a printing position to a capping position along a printbar path of travel with respect to the frame. The lock is operably coupled to the frame to releasably engage the printbar in the capping position and disengage the printbar and permit movement to the printing position.

15 Claims, 5 Drawing Sheets

(56) References Cited

U.S. PATENT DOCUMENTS

| | | | | |
|---|---|---|---|---|
| 2005/0088479 | A1* | 4/2005 | Steinfield | B41J 3/543 347/22 |
| 2006/0187504 | A1* | 8/2006 | Kawashima | B41J 25/34 358/497 |
| 2008/0286021 | A1 | 11/2008 | Asami | |
| 2012/0070217 | A1 | 3/2012 | Hendricks et al. | |
| 2012/0081491 | A1 | 4/2012 | Okumura | |
| 2012/0320126 | A1 | 12/2012 | Martin et al. | |
| 2016/0001559 | A1* | 1/2016 | Tanjo | B41J 2/16511 347/32 |
| 2016/0009111 | A1 | 1/2016 | Li et al. | |
| 2016/0193841 | A1 | 7/2016 | Naoe | |

FOREIGN PATENT DOCUMENTS

| | | |
|---|---|---|
| CN | 201151244 | 11/2008 |
| CN | 202702893 | 1/2013 |
| CN | 105584226 | 5/2016 |
| JP | 2009190285 A | 8/2009 |

* cited by examiner

PRINTING DEVICE

BACKGROUND

Printing devices—including printers, copiers, fax machines, multifunction devices including additional scanning, copying, and finishing functions, all-in-one devices, or other devices such as pad printers to print images on three dimensional objects and three-dimensional printers (additive manufacturing devices), or printing subassemblies for use in such devices—receive digital images or digital models and produce objects or images on media such as paper, polymeric materials, and other media. Images can be obtained directly from the printing device or communicated to the printing device from a remote location such as from a computing device or computing network. In the example of a sheet fed device, a sheet is selected from the media stack, typically one item at a time, and fed through a media support along a feedpath to an output tray. In a roll fed device, a web of media is fed through a media support along the feedpath to an output. The media interacts with printheads at the media support to produce images on the media. Three-dimensional printers receive a digital model or other data source of an object and can form successive layers of material to produce a three-dimensional object, such as via printer heads, extrusion, sintering-based processes or other processes.

DETAILED DESCRIPTION

Figure 1:
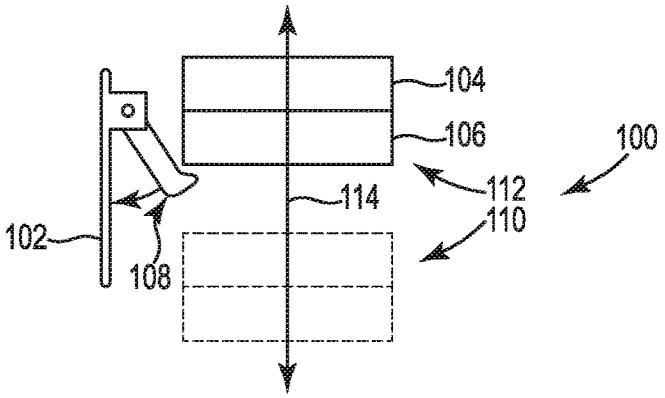
FIG. 1 is a schematic view illustrating an example printing device.

Printing devices, including printing subassemblies, can incorporate one or more printbars, such as print assemblies each having one or more print heads, to apply ink or other marking material on media during a print operation. Often, printbars, including printbars that do not traverse back and forth across printing media, are movable or selectively positionable with respect to a chassis of a complete printing device (or frame of a printing subassembly) depending on a mode of operation. These printing devices may include positioning mechanisms, or lift mechanisms, to selectively position the printbar. Such positioning mechanisms may include motors, drives, gears or pulleys that can move the printbar with respect to the printing device chassis or subassembly frame depending on a printing mode or function.

For example, the positioning mechanism may move to the printbar to a particular position a selected distance from the printing media during printing depending on media type or its thickness. Also, the positioning mechanism may move the printbar to another particular position when not printing so the print heads may be capped, or covered with a cap, to protect the print heads from drying or accumulating contaminants while waiting for print jobs or when not in operation.

In some examples the printbar may be constructed to have a mass generally greater than the caps or the force to place the caps in contact with the printbar. In examples in which the printbar spans the width of the print media and does not traverse back and forth across the print media, the mass of the printbar may be significantly larger than the capping force. Forces placed on a capped printbar—such as impact forces or vibrations if the printing device or subassembly is dropped, bumped, or shook or if another article collides against a printing device or subassembly—may generate a momentum of the printbar greater than the momentum of the cap.

The positioning mechanisms typically do not provide sufficient restraint to prevent the printbar from moving or vibrating from impact forces. For example, a positioning mechanism that may hold the printbar in a particular position under normal operational circumstance may not have enough restraint to prevent the printbar from moving from the particular position under certain forces that can result from dropping or bumping the printing device or subassembly. Additionally, such forces could back drive or otherwise unintentionally move the positioning mechanism, which could damage the drive of relatively fragile components.

A printbar crashing into a relatively fragile cap can damage the cap or the print heads. Often, a damaged to the print head or cap is so great as to prevent the printing device from operating correctly and may be in need of replacement or repair. Accordingly, the relatively fragile caps and print heads are susceptible to damage if the printing device or subassembly is transported, impacted, or otherwise moved while the print heads are capped.

FIG. 1 illustrates an example printing device 100 having a frame 102, a printbar 104, a lift mechanism 106, and a lock 108. The lift mechanism 106 is operably coupled to move the printbar 104 from a printing position 110 to a capping position 112 along a printbar path of travel 114 with respect to the frame 102. The lock 108 is operably coupled to the frame 102 to releasably engage the printbar 104 in the capping position 112 and disengage the printbar 104 and permit movement along the printbar path of travel 114 to the printing position 110.

Figure 2:
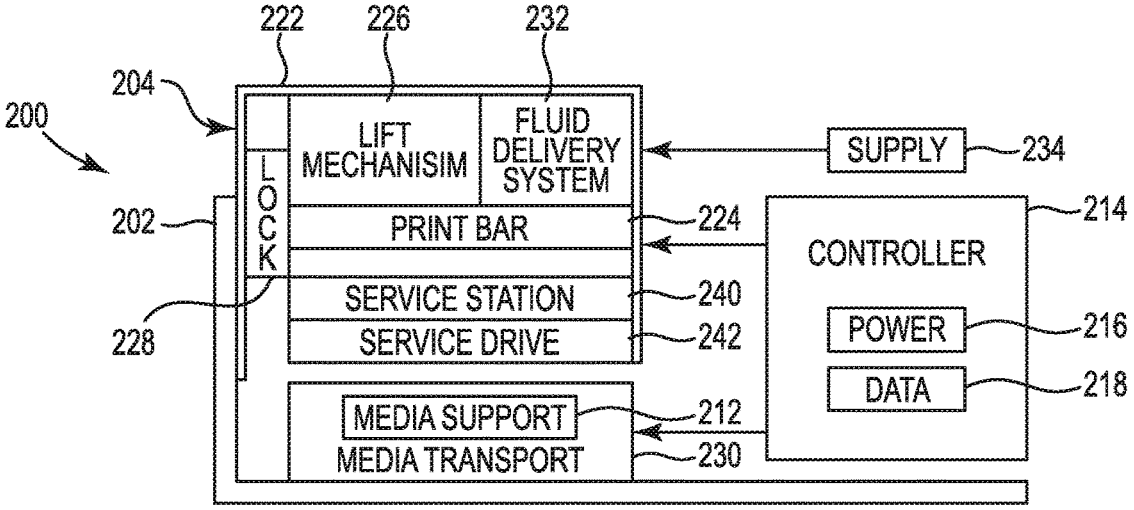
FIG. 2 is a block diagram illustrating an example printing device having a printing subassembly of the example printing device of FIG. 1.

FIG. 2 illustrates an example printing device 200 having a chassis 202 operably coupled to an installed replaceable printing subassembly 204. In one example, printing device 200 is a commercially-used inkjet printer used in offices, schools and laboratories.

The printing device 200 can include a media transport system 210 having a media support 212 adapted to present media for marking with the printing subassembly 204. For example, the media transport system 210 can include mechanisms to deliver media in the form of sheets or a web roll to the subassembly 204. A controller 214, which can include a processor, a memory device, and communication circuitry, is operably coupled to the media transport system 210 to control the media transport system 210. The controller 214 can include a power circuit 216 and image processing circuitry 218 coupled to the printing subassembly 204 to provide power and data, such as image data, to operate the subassembly 204.

The printing subassembly 204 in the example includes a frame 222, printbar 224, lift mechanism 226, and lock 228, and generally incorporates the features of printing device 100. The frame 222 can be removably coupled to the chassis 202, and can include coupling and locating features that selectively position the frame with respect to components of the printing device 200. The controller 214 can be operably coupled with signal connections to actuate the lift mechanism 226 and move printbar 224 with respect to the frame 222 along a printbar path of travel.

The subassembly 204 can additionally include a fluid delivery system 232 that is in fluid communication with the printbar 224 and a fluid supply 234. The fluid supply 234 can include a replaceable or refillable ink supply, to provide ink or other material to the printbar 224 for printing on media.

Additionally, the printing subassembly 204 in the example includes a service station 240 operably coupled to the frame 222. The service station 240 can include a mechanism to clean the printbar 224 and a cap to cover the printbar 224 when not in use. The service station 240 can also include, or be operably coupled to a service drive 242 and actuated by the controller 214 with signal connections to move the service station 240 with respect to the frame 222 along a service path of travel.

The printbar 224 includes an elongate element having one or more print heads for dispensing ink. In one example, the printbar 224 spans the width of print media on media support 212 such that the printbar 224 does not traverse back and forth across the width of the print media to dispense ink.

Printbar 224 includes one or more pens for printing. In one example, the printbar 224 includes multiple pens arranged end-on-end in an array on the printbar 224 with part of each pen overlapping a part of an adjacent pen along the span of the printbar. A printbar 224 can include, for example, two or more rows of pens in a staggered configuration in which one pen in each row extends into the overlap between pens for seamless printing across the entire span or much of the span of the printbar. In one example, the configuration of the pens can provide for seamless printing across the full span of the print media.

Pens include mechanisms configured to eject a fluid onto media such as ink, for instance, on a web or sheet. Each pen can include one or more print heads and a self-contained reservoir or cache of fluid that is applied to the print heads. Each print head can include one or more printing dice. For example, a print head can include a die configured to print cyan and magenta ink and another die can be configured to print black and yellow ink. In one example, print heads include thermal resistive drop-on-demand inkjet print heads. In another example, print heads can include piezo-resistive inkjet print heads. In still another example, print heads may comprise other mechanisms configured to eject fluid in a controlled manner.

In the example of thermal resistive inkjet print heads, a heating element is located with individualized nozzles that eject ink. An electric current is applied to heat the heating element and cause a small volume of ink to rapidly heat and become vaporized. Vaporized ink forms a pressurized bubble that ejects fluid ink through the nozzle as the ink expands. A print head driver circuit is coupled to the individual heating elements to provide energy pulses and control the ejection of liquid ink and thus the deposition of ink drops from the nozzles. The print head drivers are responsive to character generators and other image forming circuitry, which can be included as part of controller, for example, to energize selected nozzles of the print head to form images on the print media.

The lift mechanism 226 can selectively move the printbar 224 relative to the frame 222 along the printbar path of travel from a printing position, in which the print heads are proximate to the print media to one or more service positions in which the service station 240 may clean or cap the printbar 304 when the print heads are not printing. Additionally, the lift mechanism 226 can be used to finely position the printbar 224 in a particularly selected distance from a media support 212, such as "pen-to-paper spacing," in response to signals provided from a controller 214 based on the type of print media and other considerations. When used in connection with a replaceable subassembly 204, printbar-related calibrations and adjustments—such as pen-to-paper spacing, lift drive backlash equalization, and others—can be performed during manufacture instead of in the field during servicing, which can save time during repair.

The lift mechanism 226 can include a motor and a drive operated in response to signals from the controller 214. The drive can include gears or other mechanism to cause the printbar to move with respect to the frame 222 along a lift guide. The lift guide can include a rack coupled to the frame 222, and the motor is operably coupled to a pinion that engages the rack. The motor can selectively locate the pinion with respect to the rack to position the printbar 224 with respect to the frame 222.

Figure 3:
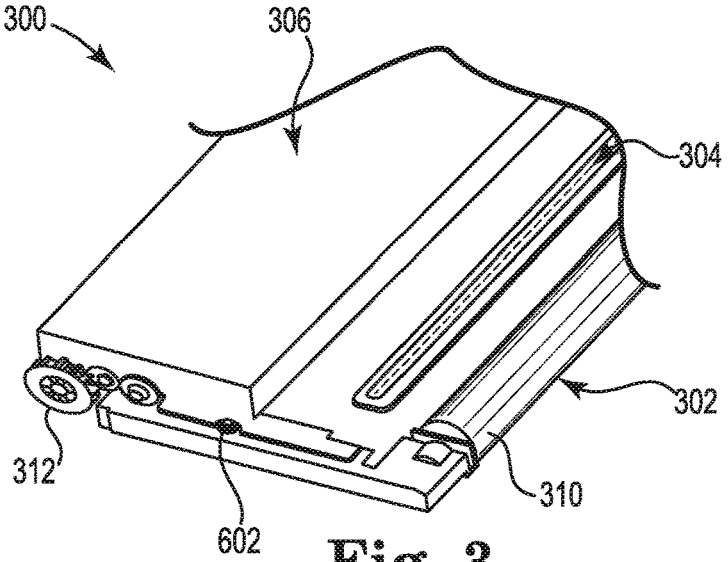
FIG. 3 is a perspective view illustrating an example service station, which is included in the example printing device of FIG. 2.

FIG. 3 illustrates an example service station 300 generally corresponding with service station 240 operably coupled to the frame 222. During printing, ink tends to build up at the nozzles of the print head. Ink build-up or residual ink can be caused from ink droplets that are not completely ejected, excess ink around the nozzle, and ink splatter reflected from the print media. The nozzles are also susceptible to being clogged from dust, quick drying ink, ink solids, and media particles.

Service station 300 includes a wipe mechanism 302 to clean and preserve the functionality of the print heads and a cap 304 to cover the print heads when not in use to reduce the likelihood of ink drying or contaminants from collecting in and over the nozzles. Service station 300 is operably coupled to the frame 222 via a service guide (not shown). Service station 300 can also include, or be operably coupled to, a service drive 306 to move the service station 300 with respect to the frame 222 and printbar 224 along the service guide in the service path of travel in response to signals from the controller 214.

The wipe mechanism 302 can include a web roll and a feed mechanism. The feed mechanism can include two spools, such as a feed supply and a take up reel, between which an exposed region of web roll 310 is wound. In one example, the spools are operably coupled to gear or cogwheel 312, which can be selectively engaged with a pawl to advance the web roll. The web roll can be advanced in response to signals from a controller 214, which can base a determination of whether to advance the web roll on such factors including health of the printbar, frequency of use, and timing of last wipe.

The cap 304 can be configured to fit and generally seal the dice of the printbar 224. In one example, the cap 304 is formed of a compliant material such as an ethylene propylene diene monomer (M-class) (EPDM) rubber or other elastomer suitable for sealing the print heads and inhibiting the print heads from drying and accumulating contaminants when not in use. The printbar 224 can be pushed into the cap 304 to seal and protect the print heads. In one example, the cap 304 can include a miniature vent to allow air pressure within the cap to slowly adjust to ambient pressure. The print heads can be capped in response to signals from the controller 214, which can base a determination of whether to cap on such factors as time between print jobs or whether the printing device has stopped printing, been powered off, or whether the subassembly 204 is being removed from the printing device 200.

The service drive 306 can selectively position the service station 300 with respect to the frame 222 and printbar 224 along the service path of travel between a wiping position to wipe the printbar with the exposed portion of the web roll 310, a capping position to cover the printbar 224 with the cap 304, and one or more other positions to permit the lift mechanism 226 to locate the printbar 224 in a printing position.

FIGS. 4A-4D illustrate various positions of the service station 300 along a service path of travel 402 with respect to the various positions of the printbar 224 along a printbar path of travel 404 with respect to the frame 222. In one example, the service path of travel 402 is orthogonal, or at some other angle, to the printbar path of travel 404.

Figure 4A:
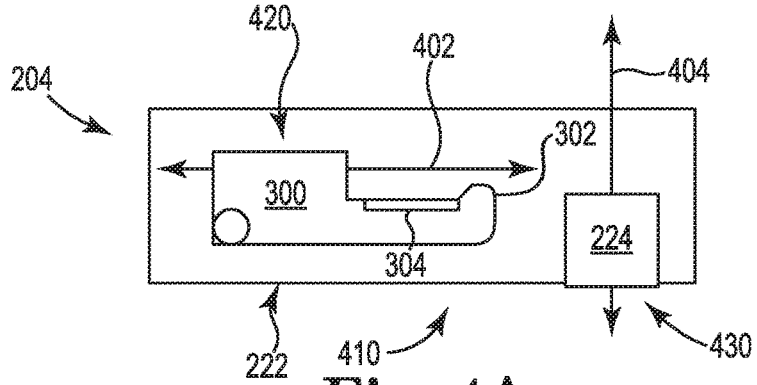
FIGS. 4A-4D are side views illustrating an example printing subassemblies of the example printing device of FIG. 2 in various configurations.

FIG. 4A illustrates the printbar 224 and service station 300 in a printing configuration 410. For printing, the service station 300 can move along the service guide in the service path of travel 402 to a latent position 420 out of the way of the printbar path of travel 404. The printbar 224 can move along the lift guide in the printbar path of travel 404 to the printing position 430. In one example, the lift mechanism 226 has positioned the printbar 224 at a selected distance from the media support 212 to effectively print on the media.

Figure 4B:
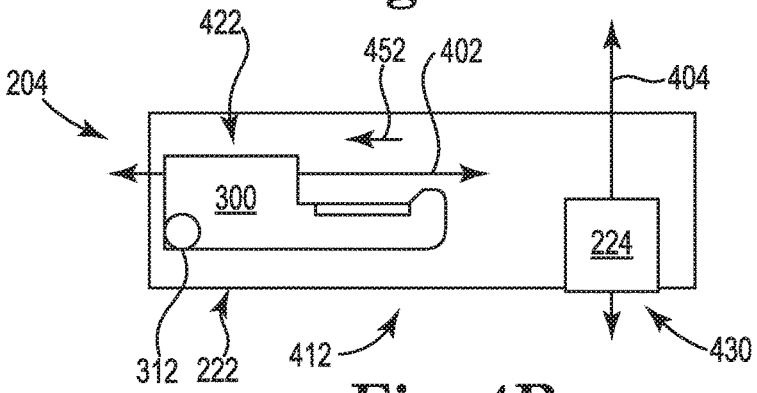

FIG. 4B illustrates the service station 300 in a winding configuration 412. The service station 300 is moved to a winding position 422, which is in a first direction 452 along the service path of travel 402 from the latent position 420 indicated FIG. 3A. In the winding configuration 412, the service station 300 is located in the winding position 422 such that the printing device 200 can operate the cogwheel 312 to advance the web roll. In this example, the printbar 224 can remain in the printing position 430.

Figure 4C:
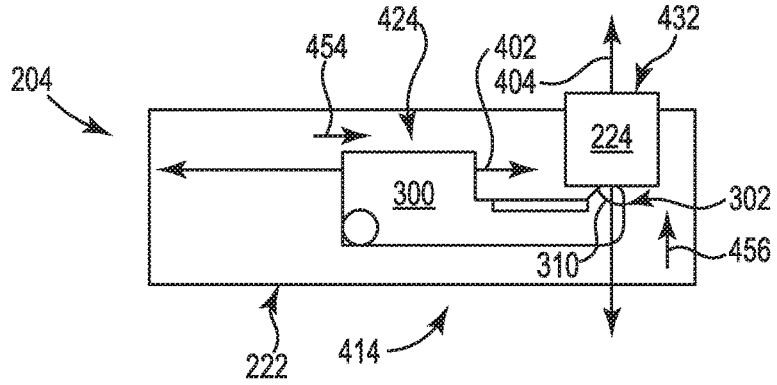

FIG. 4C illustrates the printbar 224 and service station 300 in a cleaning configuration 414. The service station 300 can be moved to a cleaning position 424, which is in a second direction 454 along the service path of travel 402 from the latent position 420. The printbar 224 is in a service position, such as cleaning position 432, which is in a first direction 456 along the printbar path of travel 404 from the printing position 320. In the cleaning configuration 414, the service station 300 is moved to the cleaning position 424 such that the exposed portion of web roll 310 can contact and clean the print heads.

Figure 4D:
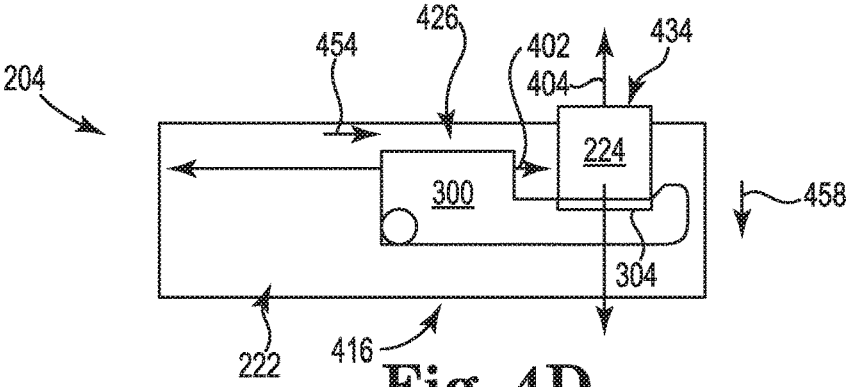

FIG. 4D illustrates the printbar 224 and service station in a capping configuration 416. The service station 300 is moved to a capping position 426, which can be in a second direction 454 along the service path of travel 402 from the cleaning position 424. The printbar 224 is in another service position, such as capping position 434, which can be in a second direction 458 along the printbar path of travel 404 from the cleaning position 432. (Alternatively, the printbar 224 can remain in the cleaning position 424.) In the capping configuration 416, the service station 300 is moved to the capping position 426 so the cap 304 can receive the print heads. The caps 304 can be urged toward the printbar 224, such as in the first direction 456, to seal the print heads, such as via a spring-loaded mechanism. Also, or alternatively, the printbar 224 can be moved in the second direction 458 to seal the print heads into the cap 304.

Figure 5A:
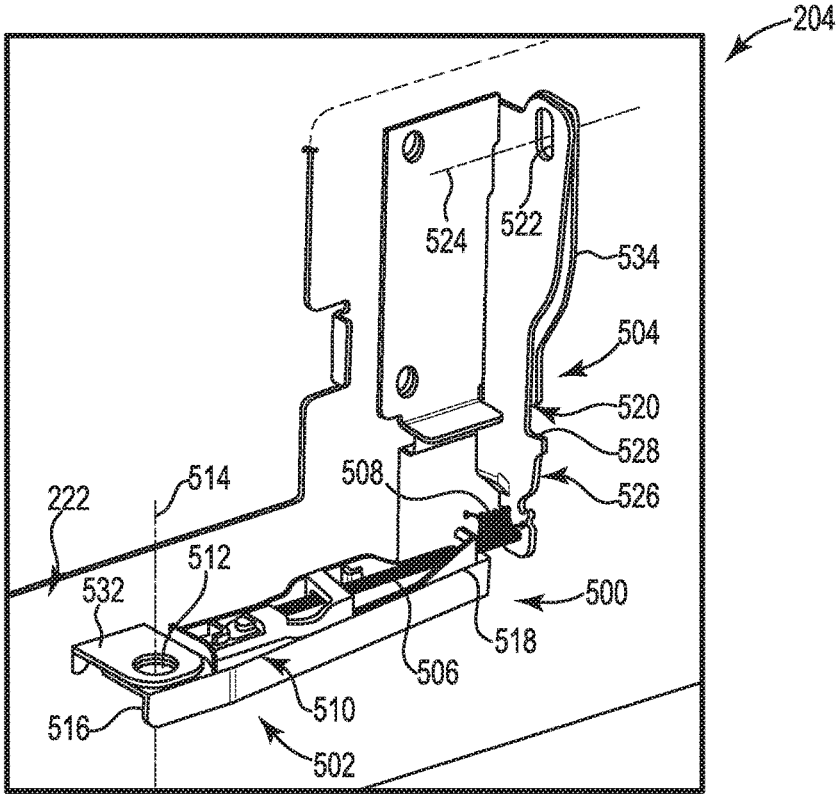
FIGS. 5A-5B are perspective views illustrating a lock of the example printing subassembly of FIG. 2, in context with features of the printing subassembly of FIG. 2.
Figure 5B:
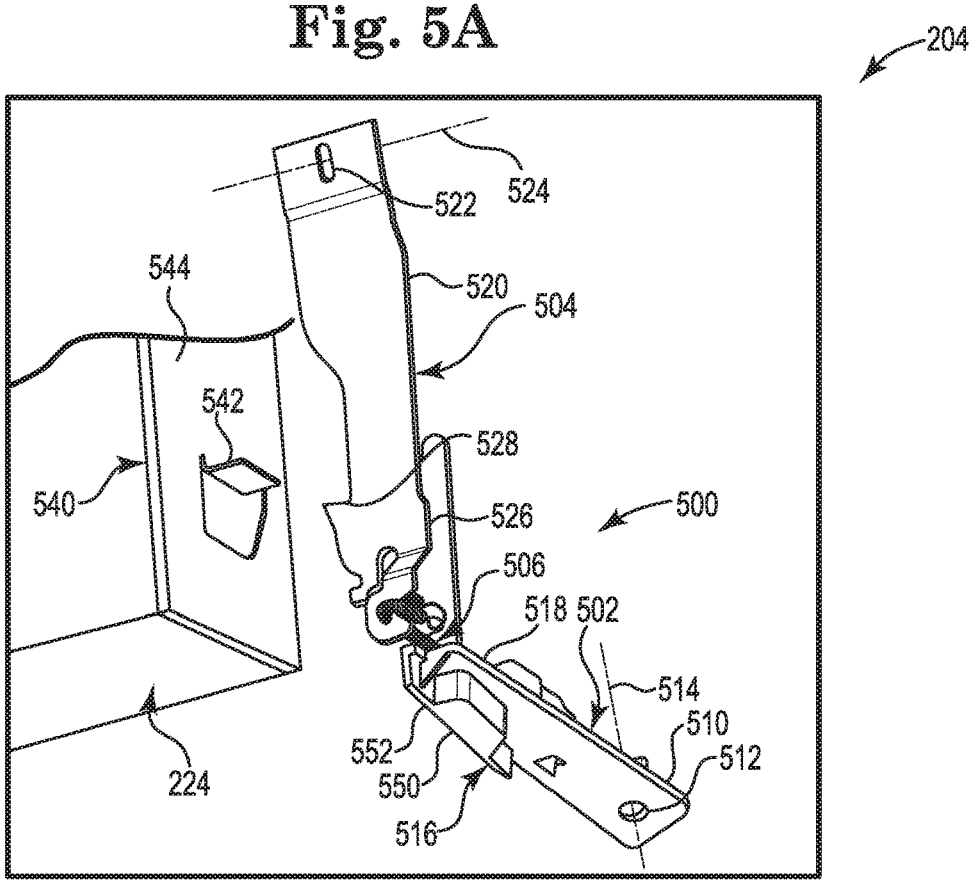

FIGS. 5A and 5B illustrate an example of a lock 500, which can correspond with lock 228. Lock 500 is coupled to the frame 222 and configured to engage the service station 300 and the printbar 224 to restrict motion of the printbar 224 toward the service station 300. For example, the lock 500 can be applied in the capping configuration 416 to restrict motion of the printbar 224 in the second direction 458. The lock 500 in the example includes an actuator arm 502, a lock arm 504, and a linkage 506 coupling the actuator arm 502 to the lock arm 504.

The actuator arm 502 includes a first end portion 510 pivotably coupled to the frame 222 via pivot 512 to turn or pivot about a first axis 514, a follower 516 to engage the service station 300, and a second end portion 518. The actuator arm 502 pivots about the first axis 514 in response to translation of the service station 300. For example, as the service station 300 moves in the second direction 454 to the capping position 426, the second end portion 518 pivots away from the frame 222. And as the service station moves in the first direction 452 from the capping position 426, the second end portion 518 pivots toward the frame 222.

The lock arm 504 includes a first end portion 520 pivotably coupled to the frame 222 via pivot 522 to pivot about a second axis 524 and a second end portion 526 having a coupling 528 to engage the printbar 224.

The linkage 506 is coupled between the actuator arm 502 and lock arm 504 in such a manner that the second end portion 526 of the lock arm 504 pivots about the second axis 524 away from the frame 222 in response to the second end portion 518 of the actuator arm 502 pivoting about the first axis 514 away from the frame 222. Also, the second end portion 526 of the lock arm 504 pivots toward the frame 222 in response to the second end portion 518 of the actuator arm 502 pivoting toward the frame 222.

The lock 500 can also include a lock arm biasing member 508 coupled between the lock arm 504 and the frame 222 to flexibly urge the second end portion 526 of the lock arm toward the frame 222 and, via linkage 506, urge the second end portion 518 of the actuating arm 502 toward the frame 222. In one example, the lock arm biasing member 508 is a coil spring.

As illustrated in FIG. 5A, the frame 222 in the example includes a generally upstanding wall 530 having one or more cutouts, shoulders, flanges, or other features 532 for pivotably attaching to the lock 500. For example, the frame 222 can include a first shoulder 534 that is pivotably coupled to the actuator arm 502 and a second shoulder 536 that is pivotably coupled to the lock arm 504 via a connector such as a shoulder screw or rivet.

As illustrated in FIG. 5B, the printbar 224 can include a catch feature 540, which can include a flange 542 or opening in a casing 544 attached to the printbar 224, to receive or engage the coupling 528 on the lock arm when second end portion 526 of the lock arm 504 is pivoted away from the frame 222. In this example, the coupling 528 can include a hook-like element to engage the locking feature 540 such as the flange 542 or side of the opening on the casing 544. In another example, the lock arm 504 can include a flange or opening and the locking feature 540 on the printbar 224 can include protrusion or hook to engage the coupling 528 on the lock arm 504.

FIG. 5B also illustrates the follower 516 in the example as a dog-legged wall 550 having a first leg 552 and second leg 554 formed in the actuator arm 502. Other examples of the follower 516 are contemplated, as will be described.

In one example, the linkage 506 includes a compliant member, such as a leaf spring, torsion spring, or compliant pin (a piece of wire), to allow a selected amount of independent motion between the actuator arm 502 and the lock arm 504. For example, the compliant member may yield allow the actuator arm 502 to continue motion in response to a force preventing motion of the lock arm 504, and vice versa. The linkage 506 can transfer motion of the actuator arm 502 to the lock arm 504, and vice versa, but may flex if the lock arm 504, for example, is under a selected amount of force. The compliant member allows for the lock 500 to work as intended if manufacturing tolerances of the lock 500, service station 300, printbar 224, and frame 222 are outside of nominal or if other mechanical issues occur.

Figure 6A:
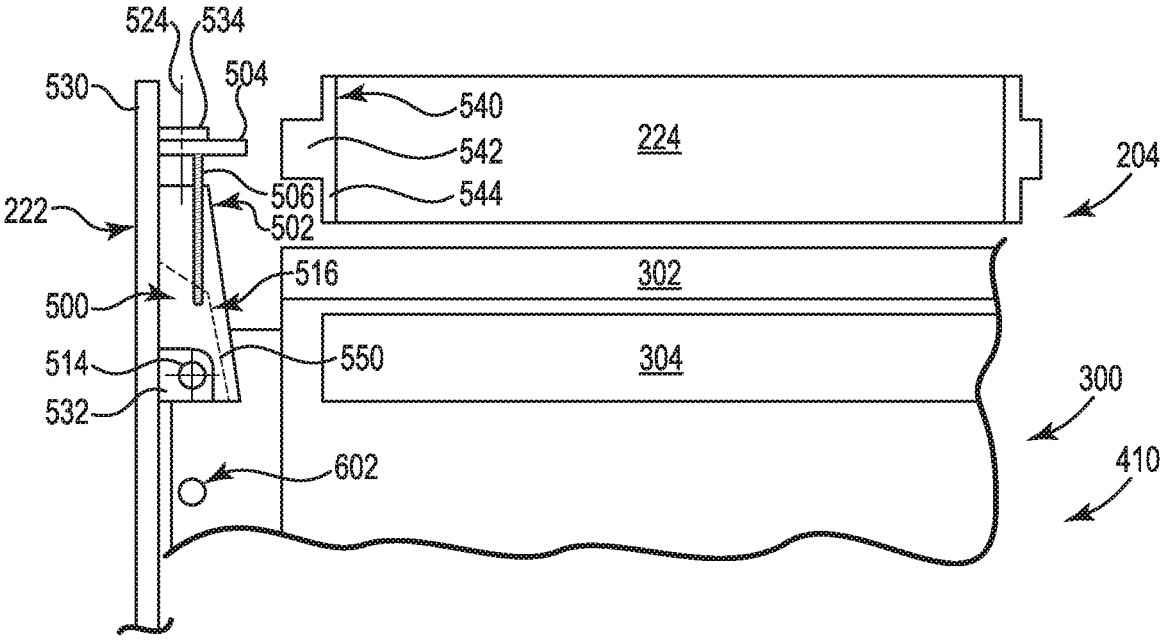
FIG. 6A-6C are plan views illustrating the example printing subassembly of FIG. 2 in various configurations.
Figure 6B:
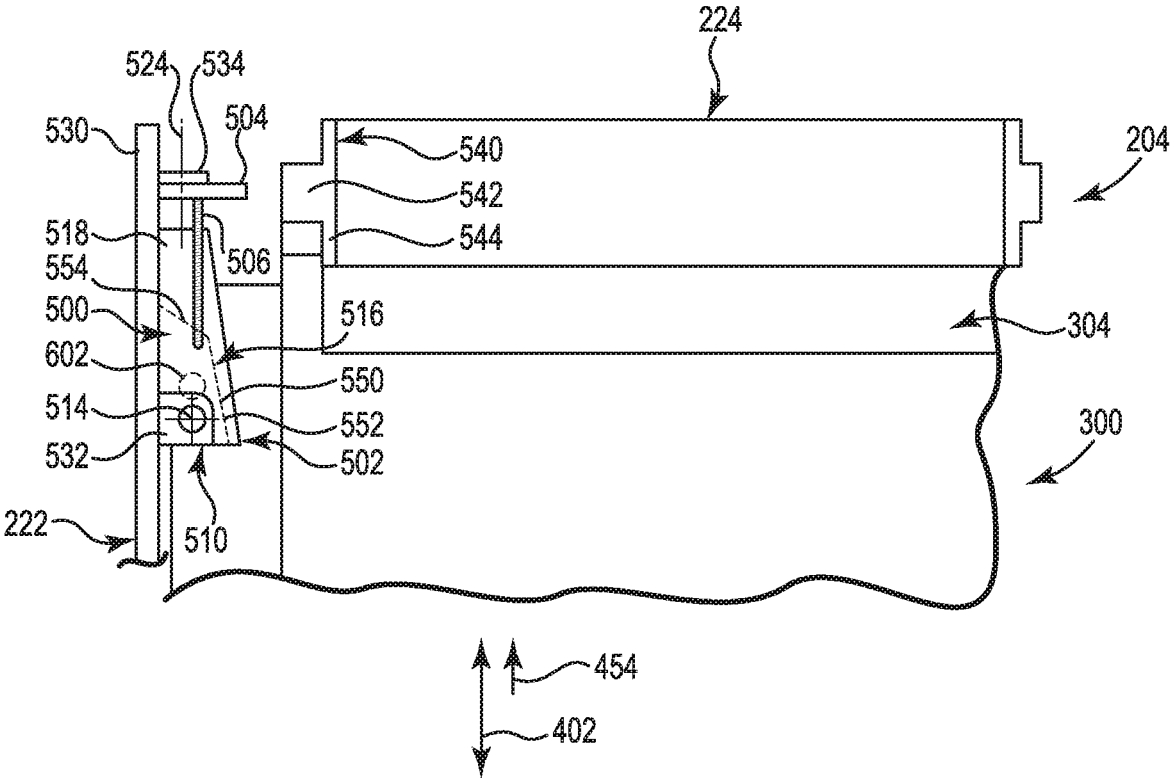
Figure 6C:
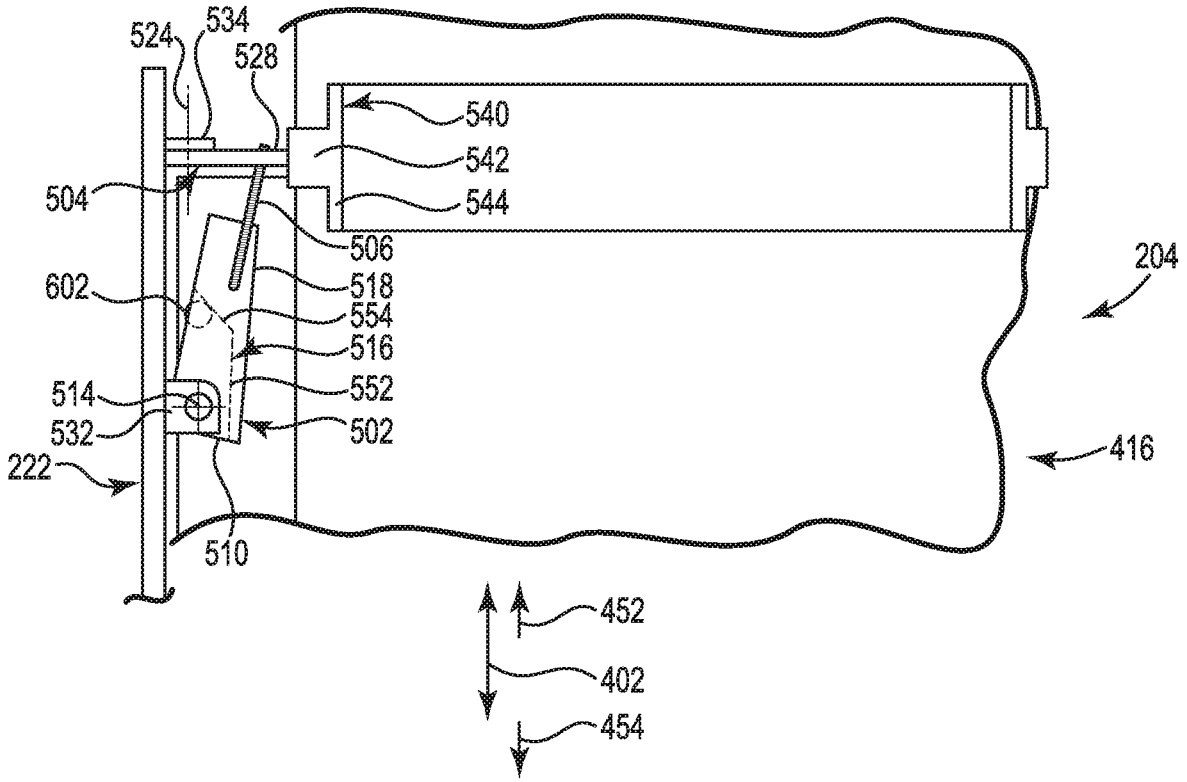

FIGS. 6A-6C illustrate operation of the lock 500 with respect to the service station 300, printbar 224, and frame 222 on subassembly 204. In the case of the coupling 528 on the lock arm 504 engaged with the catch feature 540 of the printbar 224, the lock 500 restricts (or prevents) the printbar 224 from moving in the first direction of travel 458, i.e., from the capping position 434 toward the printing position 430 along the printbar path of travel 404. While the subassembly 204 is in the capping configuration 416 and the printbar 224 is capped, the lock 500 restricts (or prevents) the printbar 224 from traveling toward the cap 304. In the case of the coupling 528 being disengaged from the catch feature 540 of the printbar 224, the printbar 224 is free to move along the printbar path of travel 404.

The service station 300 includes an actuating feature 602, which can include a cam or boss, such as a screw head exposed above a surface on the service station 300 to engage the follower 516 (shown in phantom). In this example, the follower 516 includes a wall 550 forming a channel configured to engage the actuating feature 602 such as the screw head. In another example, the follower 516 can include a cam or boss and the actuation feature 602 of the service station 300 can include a channel to engage the follower 516.

One or more locks 500 can engage the printbar 224. In one example, two locks 500, disposed on opposite walls (not shown) of the frame 222 are used to engage the ends of the printbar 224.

FIG. 6A illustrates the subassembly 204 in the printing configuration 410, similar to that illustrated in FIG. 4A. The service station 300 is in the latent position 420 and the printbar 224 is in the print position 430.

The actuating feature 602 of the service station 300 is not engaged with the actuating arm 502 of lock 500 and the coupling 528 is not engaged with the catch feature 540 of the printbar 224. The printbar 224 is free to move along the printbar path of travel 404 such as via lift mechanism 226.

FIG. 6B illustrates the service station 300 has moved in the second direction 454 of the service path of travel 402 from the latent position 420. In this configuration, the printbar 224 has moved along the printbar path of travel 404 to a service position, such as cleaning position 432 or another position to permit cap 304 to intersect the printbar path of travel 404. The actuating feature 602 (shown in phantom) is proximate the first leg 552 of wall 550 of the follower 516 in actuator arm 502.

FIG. 6C illustrates the service station 300 has moved further in the second direction 454 of the service path of travel 402 to the capping position 426. In this example, the subassembly 204 is in the capping configuration 416, similar to that illustrated in FIG. 4D, and the printbar 224 is in the capping position 434.

The actuating feature 602 (shown in phantom) of the service station 300 is engaged with the follower 516 of the actuator arm 502. In particular, the actuating feature 602 has traveled along the wall 550 to the second leg 554, where it is urged against the second leg 554, and forces the second end portion 518 of the actuator arm to pivot away from the frame 222. Accordingly, the linkage 506 has caused the second end portion 526 of the lock arm to pivot away from the frame 222, and the coupling 528 has engaged the catch feature of the 540 of the printbar 224. Motion of the printbar 224 is thus restricted in the second direction 458 of the printbar path of travel 404.

In one example, the follower 516 does not engage the actuating feature 602 of the service station 300 along the entire service path of travel 402. Instead, the actuating feature 602 engages the follower 516 in a portion of the service station path of travel 402 in which the service station 300 is proximate the capping position 426.

In one example, the first axis 514 is generally orthogonal to the service path of travel 402. As the service station 300 moves from the latent position 420 to the capping position 426, the actuating feature 602 on the service station 300 causes the actuating arm 502, and the lock arm 504 via linkage 506, to pivot away from the frame 222. In this example, as the service station moves in the first direction 452 along the service path of travel 402 from the capping position 426 (such as toward the latent position 420), the lock arm biasing member 508 causes the lock arm 504, and the actuator arm 502 via linkage, to pivot toward the frame 222. The coupling 528 is released from the catch feature 540.

In one example, the lock arm 504 can pivot about the second axis 524 such that the coupling 528 moves in a direction away from the frame 222 to engage the catch feature 540 of the printbar 222. The lock arm 504 can pivot about the second axis 524 such that the coupling 528 moves in a direction toward the frame 222 to disengage the coupling 528 from the catch feature 540 of the printbar 222. In one example, the second axis 524 is generally orthogonal to the printbar path of travel 404. In an example in which the printbar path of travel 404 is generally orthogonal to the service station path of travel 402, the second axis 524 can be generally orthogonal to the first axis 514.

In this example, the lock 500 engages the printbar 224 rather than the lift mechanism or the lift guide to secure the printbar 224 to the frame 222 and restrict movement of the printbar 224.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A printing device, comprising:

a frame;

a printbar;

a lift mechanism operably coupled to move the printbar from a printing position to a capping position along a printbar path of travel with respect to the frame; and a lock operably coupled to the frame to releasably engage the printbar in the capping position and disengage the printbar to permit movement to the printing position, the lock including:

an actuator arm having a follower and pivotable with respect to the frame about a first axis, and a lock arm coupled to the actuator arm, the lock arm to releasably engage the printbar and pivotable with respect to the frame about a second axis, the first axis generally orthogonal to the second axis.

2. The printing device of claim 1 comprising a service station operably coupled to the frame including a cap to engage the printbar in the capping position.

3. The printing device of claim 2 wherein the service station translates with respect to the frame from a latent position when the printbar is in the printing position and a service station capping position when the printbar is in the capping position.

4. The printing device of claim 1 including a media support to present a media for printing, the media having a width wherein the printbar includes print heads spanning the width of the media.

5. The printing device of claim 1 wherein the lock restricts movement of the printbar from the capping position to the print position.

6. A printing device, comprising:

a frame;

a printbar moveable with respect to the frame along a printbar path of travel from a printing position to a first position;

a service station translatable along a service path of travel from a latent position to a capping position to receive the printbar in the first position; and a lock operably coupled to the frame to releasably engage the printbar in the first position in response to the service assembly translated into the capping position and disengage the printbar in response to the service station translated toward the latent position, the lock including, an actuator arm having a follower to engage the service assembly translated into the capping position, and a lock arm coupled to the actuator arm, the lock arm to releasably engage the printbar in the first position.

7. The printing device of claim 6 wherein the service station includes a service drive.

8. The printing device of claim 6 and further comprising a chassis coupled to a media transport having a media support and a controller, wherein the frame of the printing device is removably coupled to the chassis.

9. A printing device, comprising:

a frame a printbar operably coupled to the frame;

a service station operably coupled to the frame; and a locking mechanism including:

an actuator arm pivotably coupled to the frame to pivot about a first axis in response to translation of the service station, the actuator arm including a follower to engage the service station wherein the actuator arm pivots about the first axis in response to translation of the service station;

a lock arm pivotably coupled to the frame to pivot about a second axis and including a coupling to engage the printbar in a lock position; and a linkage coupled to the actuator arm and the locking arm such that the lock arm pivots about the second axis in response to the actuator arm pivoting about the first axis.

10. The printing device of claim 9 wherein the linkage includes a compliant member operably coupled to the actuator arm and the lock arm.

11. The printing device of claim 9 wherein the service station includes a follower feature to engage the follower.

12. The printing device of claim 11 wherein the follower includes a wall having a first leg and a second leg.

13. The printing device of claim 12 wherein the actuator arm pivots about the first axis in response to the follower feature pressed against the second leg.

14. The printing device of claim 9 wherein the printbar includes a lock feature having a casing and a flange.

15. The printing device of claim 14 wherein the coupling includes a hook to engage the flange in the lock position.

* * * * *